United States Patent [19]

Okabayashi et al.

[11] Patent Number: 4,582,438

[45] Date of Patent: Apr. 15, 1986

[54] TYPE WHEEL-TYPE SELECTOR MOTOR COUPLING DETECTION DEVICE IN PRINTER

[75] Inventors: Mitumasa Okabayashi, Musashimurayama; Norio Shiga, Hachioji, both of Japan

[73] Assignee: Tokyo Juki Industrial Co., Ltd., Tokyo, Japan

[21] Appl. No.: 585,343

[22] Filed: Feb. 29, 1984

[51] Int. Cl.[4] ..... B41J 1/30; B41J 7/96

[52] U.S. Cl. ..... 400/144.2; 318/565; 400/54; 400/70; 400/320

[58] Field of Search ..... 400/61, 70, 144.2, 175, 400/355, 356, 72, 76, 320, 174, 54; 101/93.17, 93.18, 93.19; 318/565, 632, 696

[56] References Cited

U.S. PATENT DOCUMENTS

| | | | |
|---|---|---|---|
| 4,049,109 | 9/1977 | Plaza et al. | 400/144.2 X |
| 4,124,312 | 11/1978 | Johnson | 400/144.2 |
| 4,127,335 | 11/1978 | Bogert et al. | 400/144.2 |
| 4,324,496 | 4/1982 | Link | 400/144.2 |
| 4,362,980 | 12/1982 | Itzkowitz | 400/144.2 X |
| 4,389,129 | 6/1983 | Sugiura | 400/54 X |
| 4,398,837 | 8/1983 | Torii et al. | 400/54 X |
| 4,469,454 | 9/1984 | Crean | 400/144.2 |
| 4,512,676 | 4/1985 | Johannson | 400/144.2 |

FOREIGN PATENT DOCUMENTS

| | | | |
|---|---|---|---|
| 161681 | 12/1980 | Japan | 400/54 |
| 157760 | 9/1982 | Japan | 400/54 |
| 53464 | 3/1983 | Japan | 400/54 |
| 67491 | 4/1983 | Japan | 400/355 |
| 0219076 | 12/1983 | Japan | 400/144.2 |

*Primary Examiner*—Edgar S. Burr
*Assistant Examiner*—James R. McDaniel
*Attorney, Agent, or Firm*—Wenderoth, Lind & Ponack

[57] ABSTRACT

A printer in which a platen is secured to a machine frame, a carriage is movably supported on the machine frame for movement along the platen, a motor is movably supported on the carriage for reciprocal movement in a direction at right angles to the direction of movement of the carriage towards and away from the platen, a pedal type wheel is fixedly secured to the carriage and has a plurality of types, mating coupling means is formed on each of the motor and type wheel, detection means is provided to generate a detection signal upon detection of a particular rotational angle of the motor during one complete rotation of the motor, a drive circuit is provided to drive the motor and a control circuit is provided to determine presence of a detection signal and arrests the rotation of the motor when no detection signal is generated within a predetermined time period required for the motor to rotate one complete rotation.

5 Claims, 7 Drawing Figures

TYPE WHEEL-TYPE SELECTOR MOTOR COUPLING DETECTION DEVICE IN PRINTER

BACKGROUND OF THE INVENTION

This invention relates to a serial type printer having a pedal type wheel and a type selector motor adapted to be coupled to the type wheel for selectively rotating the pedal type wheel and more particularly, to a detection device for detecting the coupling of the pedal type wheel to the motor.

In a prior art printer of the above type, a type selector motor such as a stepping motor, for example, is movably mounted on a carriage for movement towards and away from a case fixedly mounted on the carriage and receiving a pedal type wheel so as to couple to and uncouple from the type wheel. In another prior art pedal type printer, the stepping motor is pivotally supported at one end on the carriage for movement between upright or inoperative and horizontal or operative positions, the type wheel is coupled to the motor with the motor held in the upright position and the printing operation is performed with the motor having the type wheel coupled thereto held in the horizontal position. However, in any one of the above-mentioned prior art pedal type printers, when the motor having the type wheel insufficiantly or improperly coupled thereto is actuated carelessly, the type wheel may not face a desired position of the platen and as a result, a selected type cannot face its associated hammer to be struck by the hammer whereby the printing operation cannot be performed or as the motor rotates, the type wheel may displace to strike against the machine frame of the printer to inflict damage to the machine frame.

SUMMARY OF THE INVENTION

Therefore, the purpose of the present invention is to eliminate the disadvantages inherent in the prior art printers by detecting insufficient or improper coupling between the motor and type wheel and arresting the rotation of the motor upon detection of such insufficient or improper coupling.

According to the present invention, there has been provided a printer comprising a platen fixedly secured to the machine frame of said printer, a carriage movably supported on said machine frame for movement along said platen, a motor movably supported on said carriage for movement in a direction at right angles to the movement direction of the carriage between an operative position in which the leading end of the drive shaft of said motor is positioned adjacent to said platen and an inoperative position in which the leading end of said motor drive shaft is positioned remote from the platen, a pedal type wheel rotatably supported on said carriage having a plurality of different printing types extending radially outwardly from the center of said type wheel and detachable engaging means provided on said motor and said type wheel, characterized by a type wheel-type selector motor coupling detection device which essentially comprises detection means provided on said carriage and motor drive shaft and adapted to generate a detection signal representing a particular rotational angle of said motor during one complete rotation of the motor in said operative position and not to generate a detection signal when said motor is in the inoperative position, a drive circuit for driving and stopping said motor by electrical control and a control circuit adapted to determine whether a detection signal has been generated in the operative position of the motor when a detection signal has not been generated within a time period required for the motor to rotate one complete rotation.

The above and other objects and attendant advantages of the present invention will be more readily apparent to those skilled in the art from a reading of the following detailed description in conjuction with the accompanying drawings which show preferred embodiments of the invention for the purpose of illustration only, but not for limiting the scope of the same in any way.

PREFERRED EMBODIMENTS OF THE INVENTION

Figure 1:
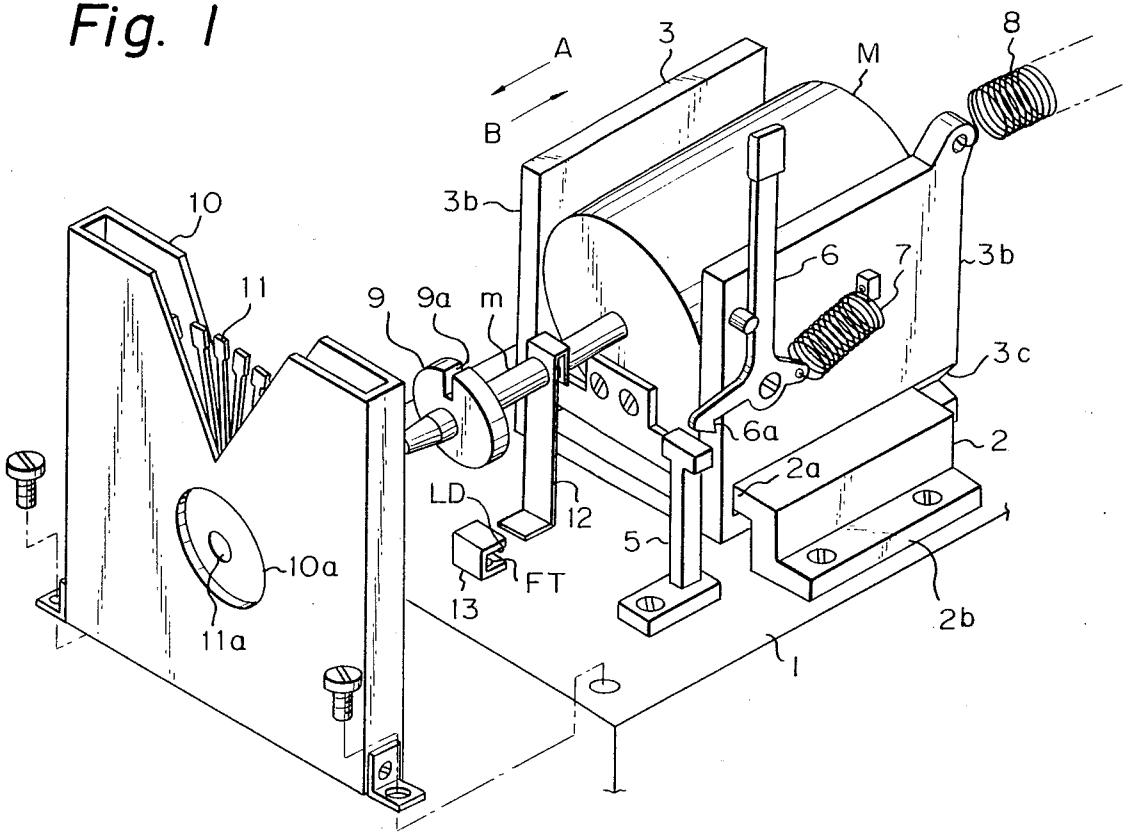
FIG. 1 is a fragmentary exploded perspective view of one embodiment of the printer constructed in accordance with the principle of the present invention.
Figure 2:
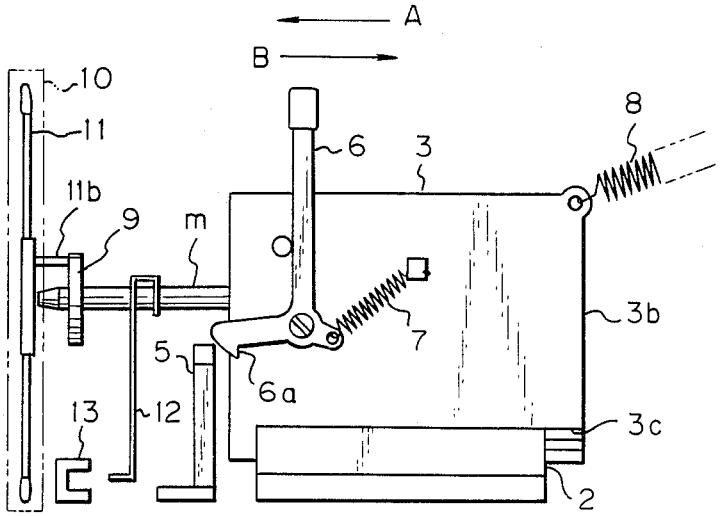
FIG. 2 is a schematic side elevational view showing the pedal type and type selector motor in the uncoupled position in the printer of FIG. 1.
Figure 3:
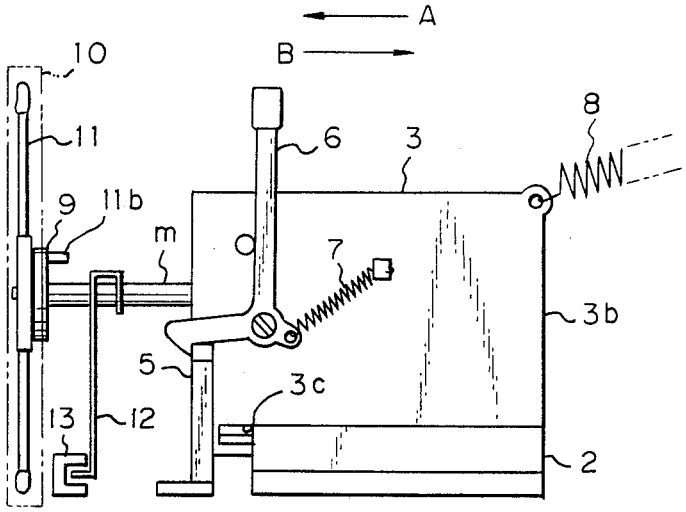
FIG. 3 is similar to FIG. 2, but shows the pedal type wheel and type selector motor in the coupled position.

The present invention will be now described referring to the accompanying drawings and more particularly, to FIGS. 1 to 3 inclusive in which the first embodiment of the printer having the type wheel-type selector motor coupling detection device of the invention incorporated therein is shown for the purpose of illustration. The printer generally comprises a carriage 1 supported on the machine frame (not shown) of the printer for movement in parallel to a platen (not shown). A pair of parallel substantially Z-shaped cross section support members 2 are provided in spaced relationship to each other on the upper surface of the carriage 1 adjacent to the opposite side edges of the carriage at right angles (in the direction shown by arrows A, B in FIG. 1) to the movement direction of the carriage with the lower horizontal portions or bases **2*b* of the support members secured to the upper surface of the carriage 1 by means of set screws, for example. A substantially U-shaped frame member 3 is slidably supported on the pair of support members 2 and has a pair of upright side arms 3*b* each having a rearwardly open engaging groove 3*c* slidably engaging on the associated Z-shaped crosssection support member 2. Fixedly received between the pair of side arms 3*b* of the frame member 3 is a stepping motor M (the same will be referred to as "motor" hereinafter) and the motor has a drive shaft m the axis of which extends in the direction of the arrows A and B. Fixedly mounted on the drive shaft m of the motor M is a disc-shaped flange 9 which has a notch 9*a* in its periphery. A vertically extending flattened hollow type wheel case 10 of substantially regular square configuration is secured to the upper surface of the carriage 1 by means of set screws between the platen and motor M at right angles to the axis of the motor drive shaft m and the case rotatably receives a pedal type wheel 11 in the upwardly open opening in the case. The type wheel 11 includes a center boss (not shown) and a plurality of arms extending radially outwardly from the boss and carrying printing types. The case 10 has a circular window 10***a* in the center for receiving the flange 9 and the type wheel 11 further has a hole 11*a* coaxial with the window 10*a* in the case 10 for receiving the leading end of the motor drive shaft m and a horizontally extending projection 11*b* on the side facing the flange 9 for engaging in the notch 9*a* in the flange to thereby provide detachable engaging means. When the leading end of the drive shaft m engages in the hole 11*a* in the wheel 11 and the projection 11*b* engages in the notch 9*a* in the flange 9, respectively, the type wheel 11 is coupled to the motor M.

A spring 8 extends between and is anchored at the opposite ends to the carriage 1 and frame 3 to normally separate the drive shaft m of the motor M from the hole 11*a* in the type wheel 11. A vertically extending anchor member 5 is secured to the upper surface of the carriage 1 adjacent to the inner end of the motor M and a lever 6 is pivoted to the outer surface of one of the side arms 3*b* of the frame member 3 (the right-hand side arm as seen in FIG. 1). The lower end of the lever 6 is bifurcated to provide two arms, and one arm 6*a* of the two arms serves as a hook to detachably engage the upper end of the anchor member 5 whereas the other arm has one end of a spring 7 anchored thereto with the other end of the spring 7 anchored to the right-hand side arm 3 to thereby normally bias the lever 6 in the counter-clockwise direction (as seen in FIGS. 1, 2 and 3) whereby the anchor member 5 and lever 6 provide detachable engaging means for holding the motor M in its operative position against the force of the spring 8 in which the drive shaft m engages in the hole 11*a* in the type wheel 11.

A substantially L-shaped plate member 12 is secured at the upper end to the drive shaft m midway between the motor body and flange 9 with the lower horizontal portion thereof spaced above the upper surface of the carriage 1 and a horizontally U-shaped cross section detector 13 is secured to the upper surface of the carriage 1 with the opening defined by the opposite arms of the detector facing the lower horizontal portion of the plate member 12 whereby the plate member and detector provide detector means for detecting a particular rotational angle of the motor M. A luminous diode LD adapted to always emit light is attached to the inner surface of the upper arm of the detector 13 and a phototransistor FT is attached to the inner surface of the lower arm of the detector. As more clearly shown in FIG. 2, when the frame member 3 is in its retracted or inoperative position in which the drive shaft m disengages from the hole 11*b*, the lower horizontal portion of the L-shaped plate member 12 is positioned out of the opening in the detector 13 and when the frame 13 is in its advanced or operative position as shown in FIG. 3, the lower horizontal portion of the L-shaped plate member 12 is disposed within the opening defined by the U-shaped cross section detector 13.

The above-mentioned detection means functions as a so-called home position sensor which normally detects a predetermined rotational angle of the motor within one complete rotation of the motor M.

Figure 6:
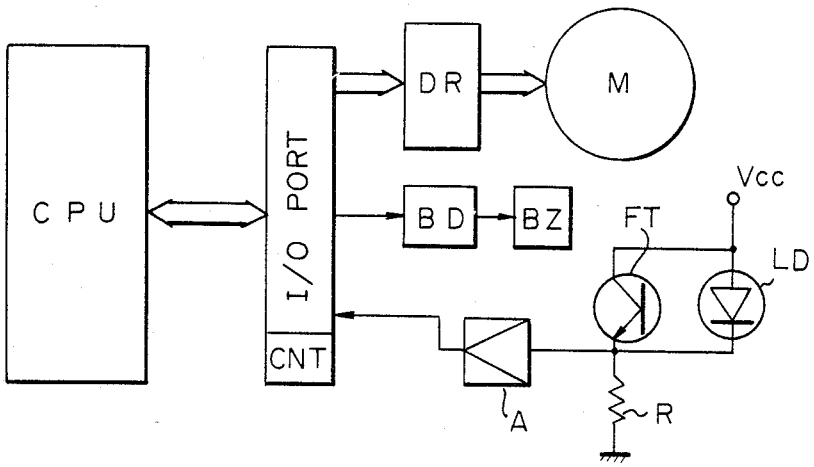
FIG. 6 is a block diagram of the control circuit for the type wheel-type selector motor coupling detection device employed in the printer of the invention.

Now description will be made on the control circuit for the type wheel-motor coupling detection device of the invention referring to FIG. 6. In FIG. 6, the control circuit includes a central processing circuit CPU having operation and control functions, a counter CNT adapted to clear addition value that is the count stored in the counter, in response to a command signal from the CPU, a drive circuit DR for the motor M, a buzzer BZ mounted on the machine frame and a drive circuit BD for the buzzer BZ. The anode of the luminous diode LD and the collector of the phototransistor FT are applied positive voltage Vcc thereto, the cathode of the luminous diode LD and the emitter of the phototransistor FT are grounded through a resistance R and voltage at the emitter of the phototransistor FT is input to the I/O port through an amplifier A.

Now description will be made on the control flow chart of the CPU referring to FIG. 7.

First of all, it is determined whether the motor M is rotating or not. If the motor M is not rotating, the addition value N in the counter CNT is reset to zero whereas if the motor M is rotating, it is determined whether the phototransistor FT is off or not, that is, the plate member 12 intervenes between the luminous diode LD and the phototransistor FT or not. If the phototransistor FT is off, the addition value N in the counter CNT is reset to zero, but if the phototransistor FT is on, that is, the phototransistor FT is receiving light from the luminous diode LD, drive pulses of the motor M are added by the counter CNT and the addition value N is compared with a predetermined number of drive pulses No at which the motor M can rotate in excess of one complete rotation. When $N<No$, the flow immediately returns, but if $N>No$, the drive circuit DR turns off to interupt the command signal, the motor M ceases to rotate and the buzzer BZ is energized.

With the above-mentioned construction and arrangement of the components of the printer having the type wheel-type selector motor coupling detection device according to the present invention incorporated therein, in operation, when the frame member 3 and accordingly, the motor M is in the retracted or inoperative position with the motor drive shaft m disengaged from the hole 11*a* in the type wheel 11 as shown in FIG. 2 and a printing command signal is input to the CPU, the motor M begins to rotate in response to the command signal, but since the frame member 3 is positioned remote from the type wheel 11, the lower horizontal portion of the L-shaped plate member 12 is disengaged from the detector 13 and thus, the phototransistor FT on the detector 13 will not be shaded and maintains its ON condition whereby the counter CNT continues to add driving pulses for the motor M. When the motor M rotates in excess of one complete rotation, the addition value N in the counter CNT becomes greater than the predetermined value No. When this occurs, the computer CPU operates, the drive circuit DR for the motor M turns off to cease the rotation of the motor M and the buzzer BR is energized to alarm that the type wheel 11 and the motor M are not coupled to each other.

In order to couple the motor M to the type wheel M, the frame member 3 is advanced towards the case 10 and accordingly, the type wheel 11 until the hook or one arm 6*a* of the lever 6 engages the anchor member 5 and the leading end of the drive shaft m of the motor M engages in the hole 11*a* in the type wheel 11 whereupon the printing operation is ready to resume.

When this occurs, the phototransistor FT turns on and in response to the turning on of the phototransistor, the counter CNT adds drive pulses for the motor M. However, since the lower horizontal portion of the L-shaped plate member 12 enters the opening defined by the horizontal U-shaped detector 13, each time the motor M rotates one complete rotation, the phototransistor FT is once shaded by the plate member 12 and turns off. Each time the phototransistor FT turns off, since the addition value N in the counter CNT is reset to zero, the relationship N>No will not be realized. Thus, when the drive shaft m of the motor M is disengaged from the hole 11*a* in the type wheel 11, the drive circuit DR of the motor M will not turn on.

Figure 4:
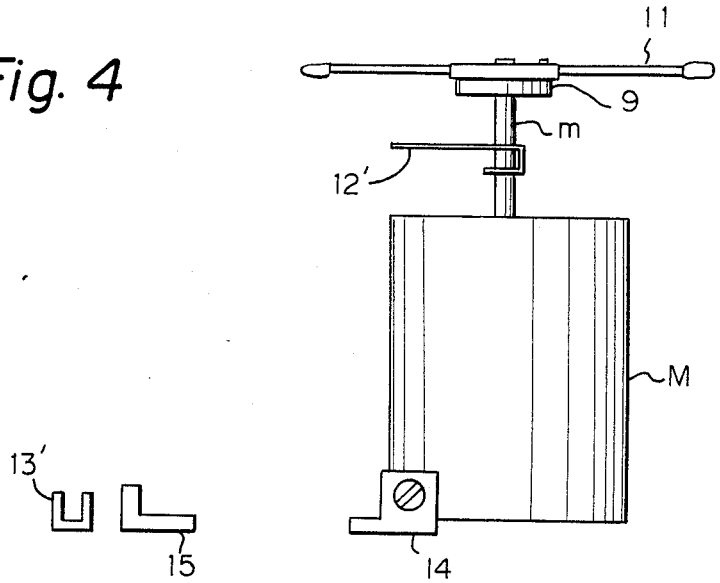
FIG. 4 is a fragmentary elevational view of a second embodiment of the printer of the invention showing the motor in the inoperative or upright position.
Figure 5:
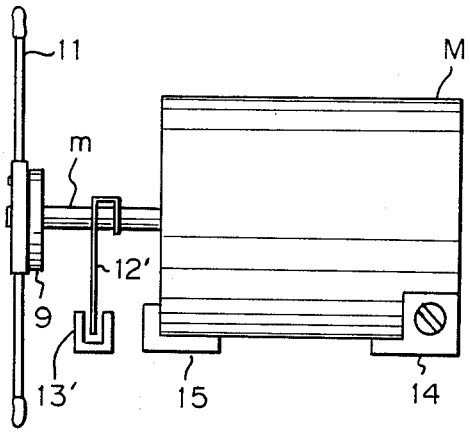
FIG. 5 is a side elevational view of said printer as shown in FIG. 4 showing the motor in the operative or horizontal position.

Turning now to FIGS. 4 and 5 which fragmentarily show a modified embodiment of the printer having the type wheel-type selector motor coupling detection device of the present invention incorporated therein. In this embodiment, the body of the motor M is pivotally supported at one end by a support member 14 which is in turn secured to the upper surface of the carriage 1 (not shown) and a modified plate member 12' is secured at one end to the motor drive shaft m midway between the opposite ends thereof. The modified plate member 12' is substantially straight different from the plate member 12 which has a substantially L-shape in the preceding embodiment. In the modified embodiment, the type wheel 11 is manually engaged on the drive shaft m by means of the center hole 11*a* (not shown) with the motor M held in its inoperative or upright position (see FIG. 4) and the motor M is then pivoted by 90° until the other end of the motor rests on a second support member 15 which is in turn secured to the upper surface of the carriage 1 (not shown) and the free end of the modified plate member 12' is received in a modified U-shaped cross section detector 13' which opens upwardly so as to cause the type wheel 11 to face the platen (not shown) whereby the printing operation is ready to start.

In the modified embodiment, the support members 2, frame member 3 and anchor member 5, and springs 7 and 8 as provided in the preceding embodiment are eliminated. The case 10 for the type wheel 11 is not shown. The other components of the modified printer are identical with the corresponding components of the preceding embodiment and description on the identical components will be omitted herein.

Figure 7:
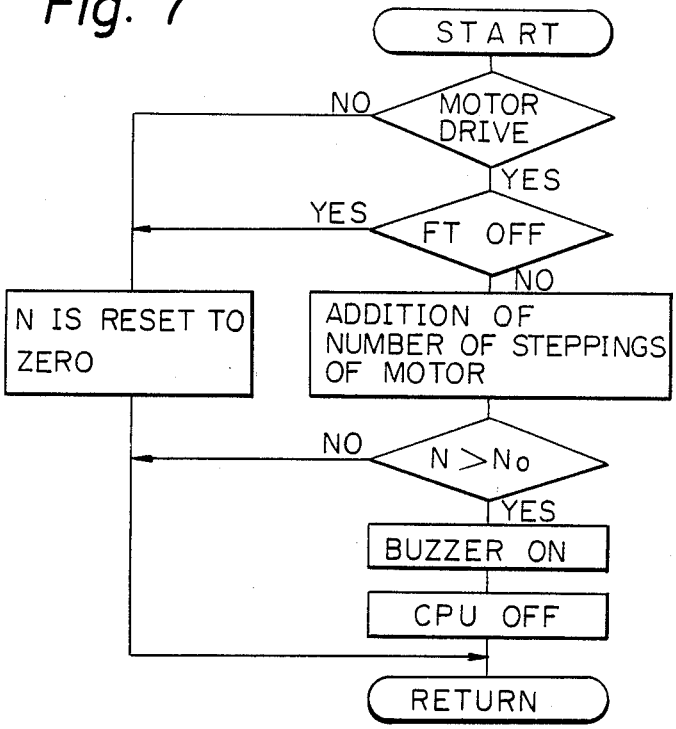
FIG. 7 is a flow chart showing the control sequence by a CPU for the type wheel-type selector motor coupling detection device of the invention.

With the above-mentioned construction and arrangements of the modified printer of the invention, in operation, when the motor M is actuated in the upright position as shown in FIG. 4, since the plate member 12' is positioned remote from the detector 13', the phototransistor FT (not shown) of the detector 13' will not turn off and thus, as seen from the flow chart as shown in FIG. 7, the drive circuit DR of the motor M will turn off and the buzzer BZ turns on to alarm an erroneously set condition of the motor M. When the motor M is then rotated by 90° to the position as shown in FIG. 5, the free end of the plate member 12' is received in the opening defined by the upwardly open detector 13' and thus, the phototransistor FT of the detector is once shaded and turned off by the plate member 12' each time the motor M rotates one complete rotation. Each time the phototransistor FT is turned off, the addition value N is reset to zero. As a result, in the flow of FIG. 7, the relationship N>No is not realized. Thus, the drive circuit DR of the motor will not turn off with the type wheel 11 coupled to the motor.

As mentioned hereinabove, according to the present invention, in a printer in which the type wheel is coupled to the type selector motor, which may be a stepping motor by moving the motor, detection means is provided to detect a particular rotational angle of the motor after the actuation of the motor, and if the particular rotational angle is not detected within a predetermined time period, it is determined that the motor is not positioned in a position wherein proper printing operation can be performed and thus, the type wheel is insufficiently or properly coupled to the motor and the motor is then caused to cease the rotation whereby improper printing due to displacement of the type wheel and/or damages of the case, carriage and/or the like by being struck by the displaced type wheel can be effectively prevented. Since the coupling of the type wheel to the type selector motor is detected by detection means adapted to detect a particular rotational angle of the motor, any separate detection means is not required and the cost of the detection device can be reduced.

Furthermore, in the illustrated embodiments of the invention, although it is determined whether the CPU should be turned on or not based on the addition value derived by adding the number of steppings of the stepping motor, it is also contemplated that a timer circuit adapted to be set for a time period required for the motor to rotate one complete rotation after the actuation thereof and presence of a detection signal generated in the timer circuit within the predetermined time period is detected.

Although not shown, the plate member 12 or 12' may be provided at the lower end with a horizontally U-shaped cross section portion defining an opening between the upper and lower or opposite arms of the U-shape which opens towards the type wheel, and the inner surfaces of the upper and lower arms may have a luminous diode LD and a phototransistor FT secured thereto, respectively, to provide a detector. In connection, with this, a substantially L-shaped plate member may be secured to the upper surface of the carriage in place of the detector 13 or 13' with the horizontal upper portion thereof extending towards the detector so as to enter the opening defined by the U-shaped lower end portion or detector when the motor advances to the operative position.

In the above described embodiments the detection of a particular rotational angle of the motor is performed by optical means, but the detection can be equally performed by a magnetic sensor or reed switch (contact).

While preferred embodiments of the invention have been shown and described in detail, it will be understood that the same are for illustration purpose only and not to be taken as a definition of the invention, reference being had for this purpose to the appended claims.

What is claimed is:

1. A printer comprising a machine frame; a platen fixedly secured to said machine frame; a carriage movably supported on said machine frame for movement along said platen in a first direction; a motor having a drive shaft movably supported on said carriage for movement in a second direction at right angles to said first direction between an operative position in which the leading end of said drive shaft is positioned adjacent to said platen and an inoperative position in which the leading end of said motor drive shaft is positioned remote from said platen; a pedal type wheel rotatably supported on said carriage having a plurality of different printing types extending radially outwardly from the center of said type wheel; detachable engaging means on said motor drive shaft and said type wheel for engaging said drive shaft with said type wheel so that said type wheel is rotatively drivable by said drive shaft; and a type wheel-type selector motor coupling detection device, including:

detection means, provided on said carriage and motor drive shaft, for both detecting, and generating a detection signal representing, a particular rotational angle of said motor during one complete rotation of said motor when and only when said motor is in said operative position, a motor drive circuit for driving and stopping said motor by electrical control, and a control circuit, responsive to the absence of said detection signal, for controlling said motor drive circuit to stop the rotation of the motor when said detection signal has not been generated within a time period required for the motor to rotate one complete rotation.

2. The printer as in claim 1, in which said motor is a stepping motor and said type wheel is housed in a case fixedly secured to said carriage.

3. The printer as in claim 1, in which said detachable engaging means comprises a flange having a notch formed on said motor drive shaft, a center hole formed in said type wheel and a horizontal projection formed on the side of the type wheel facing said flange to be received in said notch when said motor is in said operative position.

4. The printer as in claim 1, in which: said detection means comprises a substantially L-shaped plate member secured to said motor drive shaft, having a horizontal lower portion directing toward said type wheel, a detector member of horizontally U-shape cross section having upper and lower arms, fixedly secured to said carriage so as to open horizontally towards said horizontal lower portion of said plate member for receiving said plate member horizontal lower portion when said motor is in said operative position, and a luminous diode and a phototransistor attached to the inner surfaces of said upper and lower arms of said detector; and said control circuit comprises a computer having operation and control functions, a counter adapted to clear its count in response to a signal from said computer, said motor drive circuit, buzzer means for sounding an alarm when the coupling of said type wheel to said motor is improper, and a buzzer drive circuit for driving said buzzer means.

5. The printer as in claim 1, in which said detection means comprises a substantially straight upright plate member secured at one end to said motor drive shaft and a detector member of upwardly open U-shaped cross section having opposing arms secured to said carriage for receiving the other end of said plate member when said motor is in said operative position and a luminous diode and a phototransistor attached to the inner surfaces of said opposing arms.

* * * * *